US008550459B2

(12) United States Patent
Sekiguchi et al.

(10) Patent No.: US 8,550,459 B2
(45) Date of Patent: Oct. 8, 2013

(54) SHEET FEEDING APPARATUS AND IMAGE FORMING APPARATUS

(75) Inventors: Hajime Sekiguchi, Abiko (JP); Takeshi Suga, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/204,151

(22) Filed: Aug. 5, 2011

(65) Prior Publication Data

US 2012/0049442 A1 Mar. 1, 2012

(30) Foreign Application Priority Data

Aug. 25, 2010 (JP) ..... 2010-188238

(51) Int. Cl.
*B65H 7/02* (2006.01)

(52) U.S. Cl.
USPC ..... 271/265.03; 271/265.02; 271/226; 271/171; 271/152

(58) Field of Classification Search
USPC ..... 271/171, 226, 265.01, 265.02, 265.03, 271/153, 155
See application file for complete search history.

(56) References Cited

U.S. PATENT DOCUMENTS 5,028,042 A * 7/1991 Yamada et al. ..... 271/9.06
5,678,127 A 10/1997 Suga
5,689,759 A * 11/1997 Isemura et al. ..... 399/45
6,010,261 A * 1/2000 Maekawa ..... 400/605
6,059,285 A 5/2000 Suga et al.
6,260,840 B1 7/2001 Suga et al.
6,378,858 B1 4/2002 Suga
7,641,188 B2 1/2010 Hiura et al.
7,900,909 B2 3/2011 Hiura et al.
2007/0251402 A1* 11/2007 Monden et al. ..... 101/116
2011/0169215 A1* 7/2011 Oh et al. ..... 271/227
2011/0241285 A1 10/2011 Sekiguchi

FOREIGN PATENT DOCUMENTS

JP 6-009064 A 1/1994

* cited by examiner

*Primary Examiner* — Michael McCullough
*Assistant Examiner* — Howard Sanders
(74) *Attorney, Agent, or Firm* — Fitzpatrick, Cella, Harper & Scinto

(57) ABSTRACT

A sheet feeding apparatus includes a manual feed tray on which sheets are stacked, a feeding member, side regulating plates, a detecting portion which detects positions of the side regulating plates and detects a width size of the sheets, an operation panel which receives an input of width size information of the sheets from a user, and a control circuit which compares width size information detected by the detecting portion and the width size information input to the operation panel, and stops a sheet feeding operation of the feeding member when the two pieces of width size information are different, and the control circuit compares the width size information of the detecting portion and the width size information of the operation panel, per sheet before the feeding member starts feeding the sheet.

7 Claims, 6 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus which forms an image on a sheet fed by this sheet feeding apparatus.

2. Description of the Related Art

Conventionally, an image forming apparatus such as a copying machine or printer which forms an image on a sheet is generally equipped with cassettes which accommodate a great amount of sheets of regular sizes. Further, an image forming apparatus of some type is equipped with a so-called manual sheet feeding apparatus which feeds sheets such as sheets of an irregular size such as postcards, OHP or special paper placed by the user on the side of the apparatus body.

This manual sheet feeding apparatus is discussed in Japanese Patent Laid-Open No. 06-009064. With this sheet feeding apparatus, the user moves side regulating plates which are a pair of aligning members provided in a manual feed tray, to come close to and separate from each other to align the widths of sheets in a direction crossing a sheet feeding direction. Further, with the sheet feeding apparatus, a detecting portion detects the sheet width size based on the movement amount of the side regulating plates. Furthermore, the sheet feeding apparatus feeds sheets when sheet width size information input by the user through an operation panel and the sheet width size detected by the detecting portion match.

In addition, the side regulating plates not only align the sheet widths, but also guide sheets such that jamming of the sheets does not occur due to skew feeding of the sheets when the sheets are fed.

Further, there are cases where a conventional sheet feeding apparatus is commonly used in an image forming apparatus of a different specification.

Incidentally, the conventional sheet feeding apparatus determines whether sheet width size information input to the operation panel and the sheet width size detected by the detecting portion match only when sheet width size information is input to the operation panel.

Therefore, the conventional sheet feeding apparatus has the following issues.

(1) When sheets are fed, jamming of the sheets occurs in the apparatus body of the image forming apparatus, and, while the user is removing the jammed sheets, the user contacts and displaces the side regulating plates in a direction away from the sheets. Further, it is assumed that, after the size is set in the operation panel, the side regulating plates are moved due to a user's unintentional operation. When the user restarts the image forming apparatus without knowing that the positions of the side regulating plates are displaced, the sheet feeding apparatus feeds sheets the widths of which are not regulated by the side regulating plates. As a result, there is a concern that skew fed sheets are jammed in the sheet feeding apparatus or in the image forming apparatus.

Further, when sheets on the manual feed tray run out, the user places sheets having narrower widths than the sheets which have been placed on the manual feed tray so far, and starts the sheet feeding apparatus without changing sheet width size information in the operation panel. Also, in this case, the sheet feeding apparatus skew feeds the sheets having narrow widths which are not regulated by the side regulating plates, and therefore there is a concern that the sheets having narrow widths are jammed in the sheet feeding apparatus or in the image forming apparatus.

(2) When a sheet feeding apparatus is commonly used in an image forming apparatus of a different specification, there are cases where the sheet feeding apparatus feeds sheets which are out of the range of sheet widths which allow the image forming portion of the image forming apparatus to form images.

Assume, for example, that, in a sheet feeding apparatus equipped in an image forming apparatus which forms an image on a sheet up to 210 mm wide (A4-R feed), the user sets the width size to the A4-R width (210 mm) on the operation panel and sets the side regulating plates to the A4-R width. Further, when the sheet feeding apparatus are feeding sheets, jamming of sheets occurs and the user displaces the side regulating plates from the positions for the A4 width (297 mm) while removing the jammed sheets. In this state, if the user erroneously places sheets of the A4 width (297 mm) on the manual feed tray, the sheet feeding apparatus feeds the sheets of the A4 width (297 mm). However, the image forming apparatus cannot form images on the sheets having the width size of 297 mm. Therefore, there are cases where the sheets of the A4 width (297 mm) are jammed in the image forming apparatus. Further, there is a concern that the jammed sheets damage the image forming apparatus.

The present invention provides a sheet feeding apparatus which, when no sheet is temporarily fed and the user displaces the positions of aligning members, can detect that the positions of the aligning members are displaced and stop feeding sheets.

SUMMARY OF THE INVENTION

The present invention provides a sheet feeding apparatus which, when no sheet is temporarily fed and the user displaces the positions of aligning members, detects that the positions of the aligning members are displaced and stops feeding sheets when the sheet feeding apparatus is commonly used in an image forming apparatus of a different specification.

The present invention provides an image forming apparatus equipped with a sheet feeding apparatus which can detect that the positions of the aligning members are displaced.

The sheet feeding apparatus according to the present invention includes a sheet tray on which a sheet is stacked, a feeding member which feeds the sheet stacked on the sheet tray, an aligning member which aligns a width of the sheet stacked on the sheet tray, in a direction crossing a sheet feeding direction, a size detecting portion which detects a position of the aligning member and detects a width size of the sheet, an information inputting portion which receives an input of width size information of the sheet, and a controlling portion which compares the width size information of the size detecting portion and the width size information of the information inputting portion before the feeding member starts feeding the sheet, and the controlling portion which compares width size information detected by the size detecting portion and the width size information input in the information inputting portion, and stops a sheet feeding operation of the feeding member when the pieces of width size information are different, wherein the controlling portion compares the width size information of the size detecting portion and the width size information of the information inputting portion, per sheet before the feeding member starts feeding the sheet.

Further features of the present invention will become apparent from the following description of exemplary embodiments with reference to the attached drawings.

BRIEF DESCRIPTION OF THE DRAWINGS

FIGS. 3A and 3B are front views for describing an operation of the sheet feeding apparatus in FIG. 2, wherein FIG. 3A is a view of a sheet feeding apparatus on which a user places sheets and FIG. 3B is a view of a sheet feeding apparatus on which no sheet is placed;

DESCRIPTION OF THE EMBODIMENTS

Hereinafter, a sheet feeding apparatus and an image forming apparatus having the sheet feeding apparatus according to an embodiment of the present invention will be described with reference to the drawings.

Figure 1:
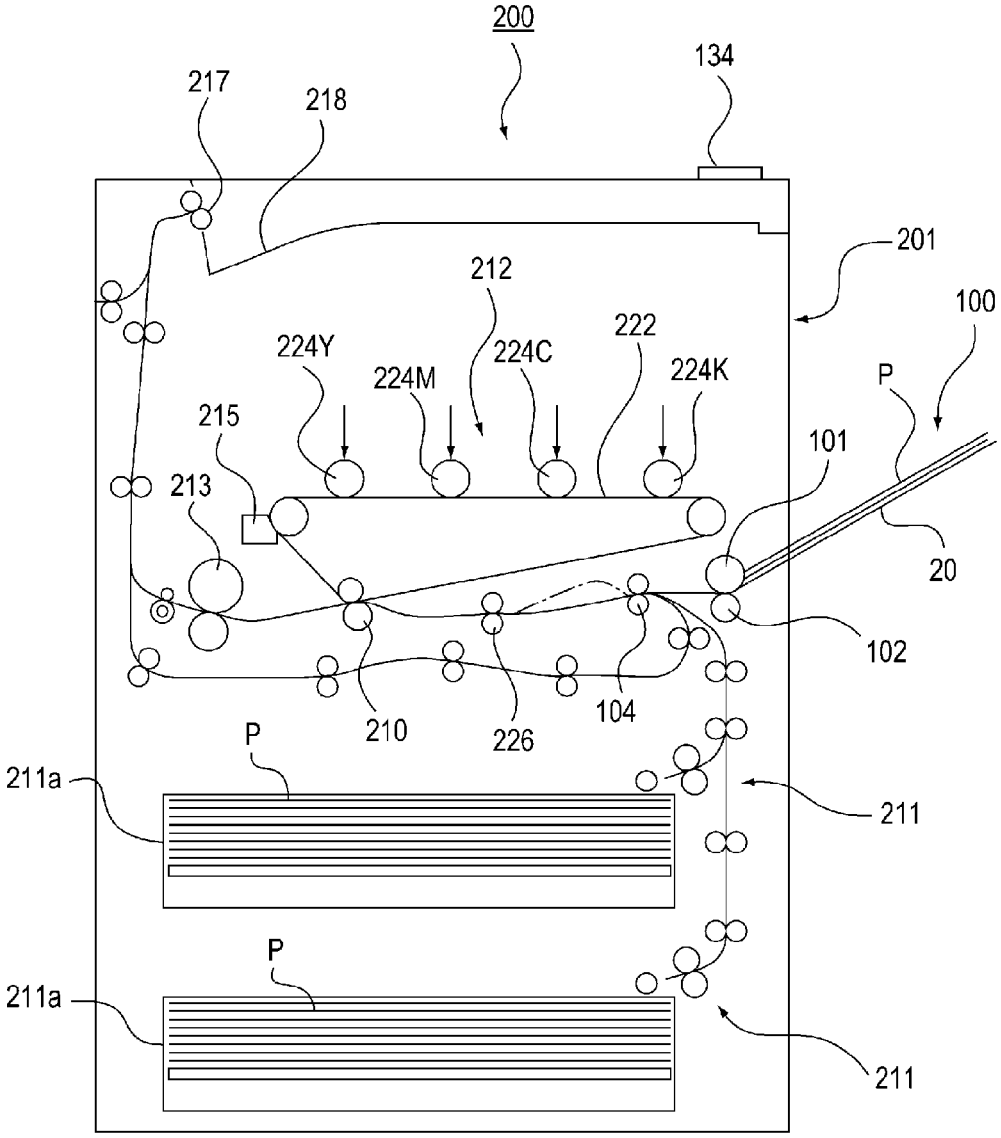
FIG. 1 is a schematic sectional view of an image forming apparatus along a sheet conveying direction according to an embodiment of the present invention.

FIG. 1 is a schematic sectional view of the image forming apparatus along the sheet conveying direction.

(Image Forming Apparatus)

An image forming apparatus 200 includes, for example, an apparatus body 201, a cassette feeding portion 211, an image forming portion 212, a fixing device 213, a tray 218 and a sheet feeding apparatus 100, and forms color images on sheets.

The cassette feeding portion 211 includes two-tier cassettes 211*a* which accommodate recording sheets P and which are detachably attached to the apparatus body 201. The image forming portion 212 includes cylindrical photosensitive drums (224Y, 224M, 224C and 224K) associated with each color, and a development device and a charger arranged around the photosensitive drums, and forms a toner image on a sheet according to a general electrophotographic system. Colors include yellow (Y), magenta (M), cyan (C) and black (K). In the downstream of the image forming portion 212 in the sheet conveying direction, the fixing device 213 which fixes a toner image on a sheet, a pair of discharge rollers 217 and the tray 218 on which sheets on which images have already been formed are disposed. In the upper part of the apparatus body 201, an operation panel 134 is provided in which the user inputs information required to operate the image forming apparatus 200.

When image data is input to the operation panel 134, the image forming apparatus 200 selects one of the two cassettes 211*a* and starts feeding the sheets P. Meanwhile the outer peripheral surface of the photosensitive drum 224 of the image forming portion 212 is irradiated with light (for example, laser light) to which data processing is executed. The outer peripheral surfaces of the photosensitive drums 224 are charged in advance by a primary charger (not illustrated). Hence, when the photosensitive drum 224 is irradiated with light, an electrostatic latent image is formed on the outer peripheral surface. The electrostatic latent image is developed using toner by the development device (not illustrated) as a toner image. The toner image formed on each photosensitive drum 224 is sequentially overlaid and primarily transferred onto a primary transfer belt 222 and conveyed to a secondary transfer portion 210.

The sheet fed from the cassette feeding portion 211 is received by a pair of registration rollers 226 and skew feeding of the sheet is corrected. Further, a conveyance timing of the sheet is adjusted such that the position of the sheet is aligned with the toner image which is primarily transferred to the primary transfer belt 222, and conveyed between the primary transfer belt 222 and secondary transfer portion 210, so that a toner image is secondarily transferred onto the sheet. Remaining toner on the primary transfer belt 222 is cleaned by a belt cleaning device 215 after secondary transfer. Subsequently, the sheet is heated and pressured by the fixing device 213, a toner image is fixed thereon and the sheet is discharged to the tray 218 by the pair of discharge rollers 217.

Although the image forming apparatus 200 forms toner images on the sheets P fed from the cassette 211*a* with the above description, toner images can also be formed on the sheets P fed from the manual sheet feeding apparatus 100 which will be described below.

(Sheet Feeding Apparatus)

Figure 2:
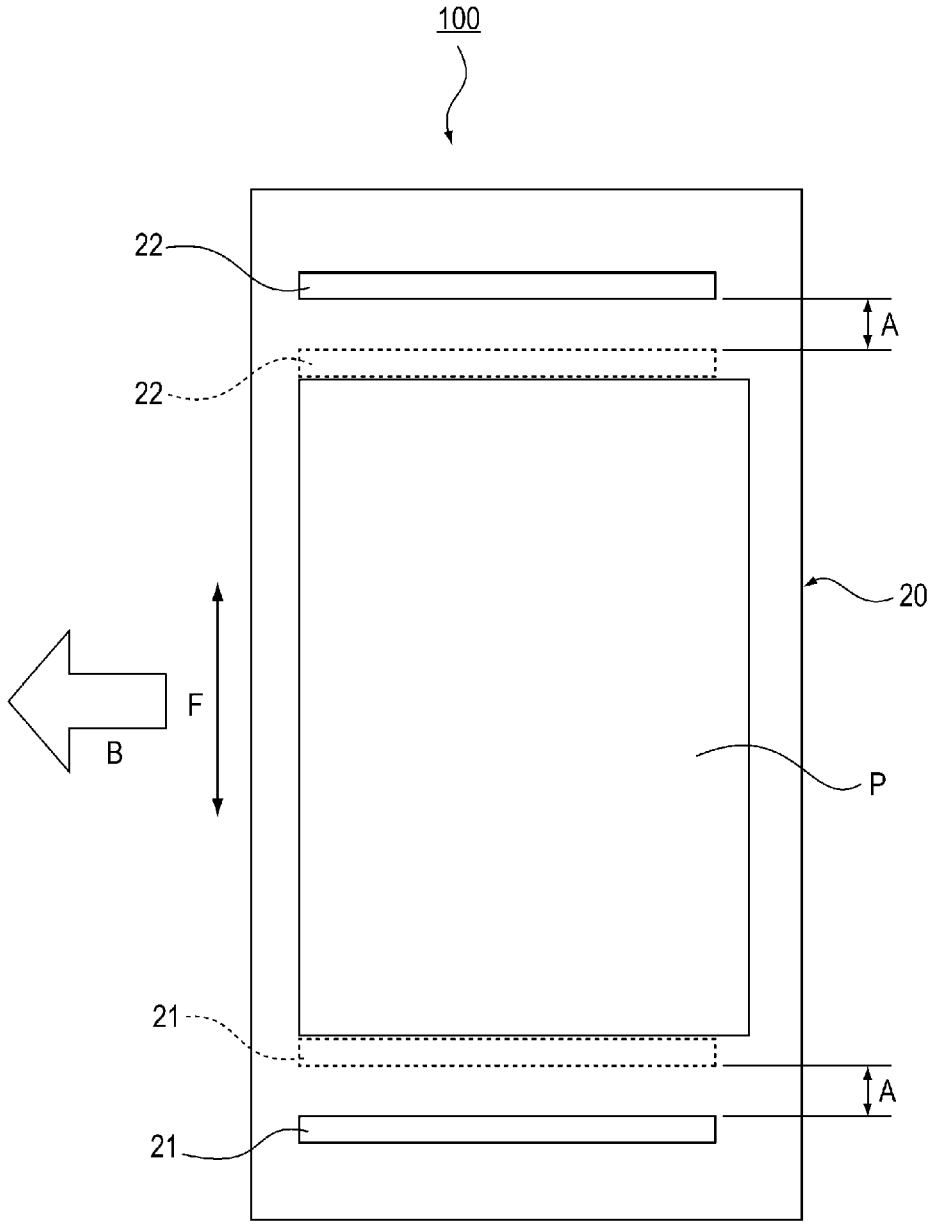
FIG. 2 is a schematic plan view of a sheet feeding apparatus according to an embodiment of the present invention.
Figure 3A:
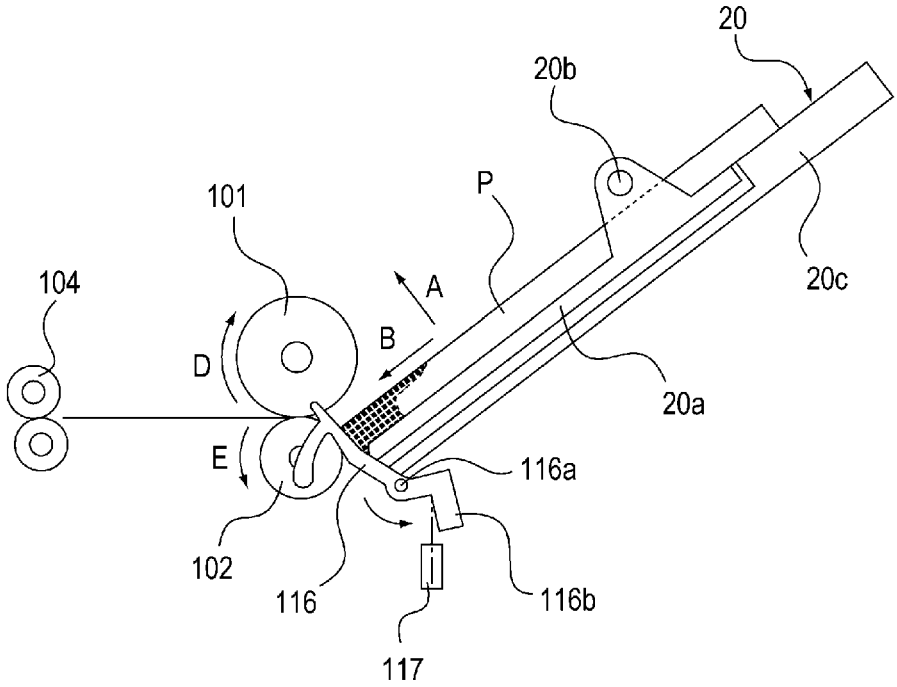
Figure 3B:
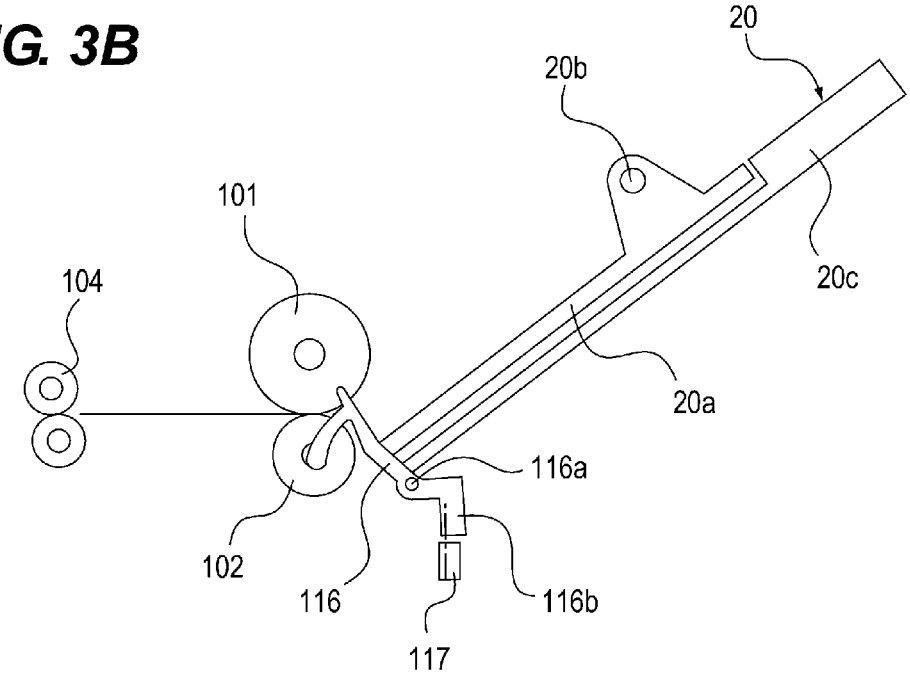
Figure 4:
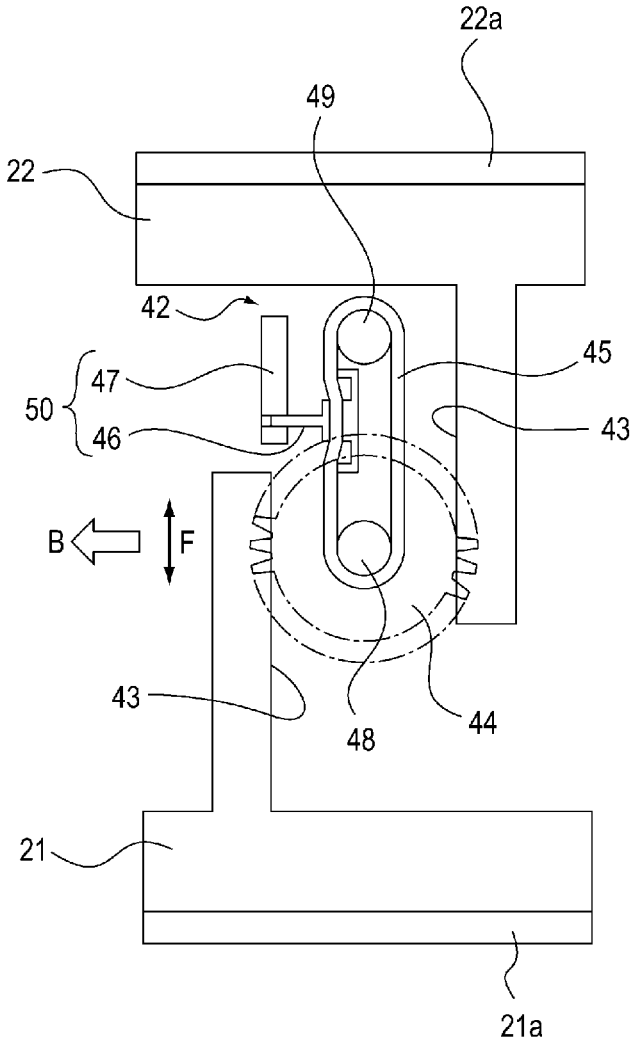
FIG. 4 is a plan view of a mechanism of detecting positions of side regulating plates of a pair of aligning members.
Figure 5:
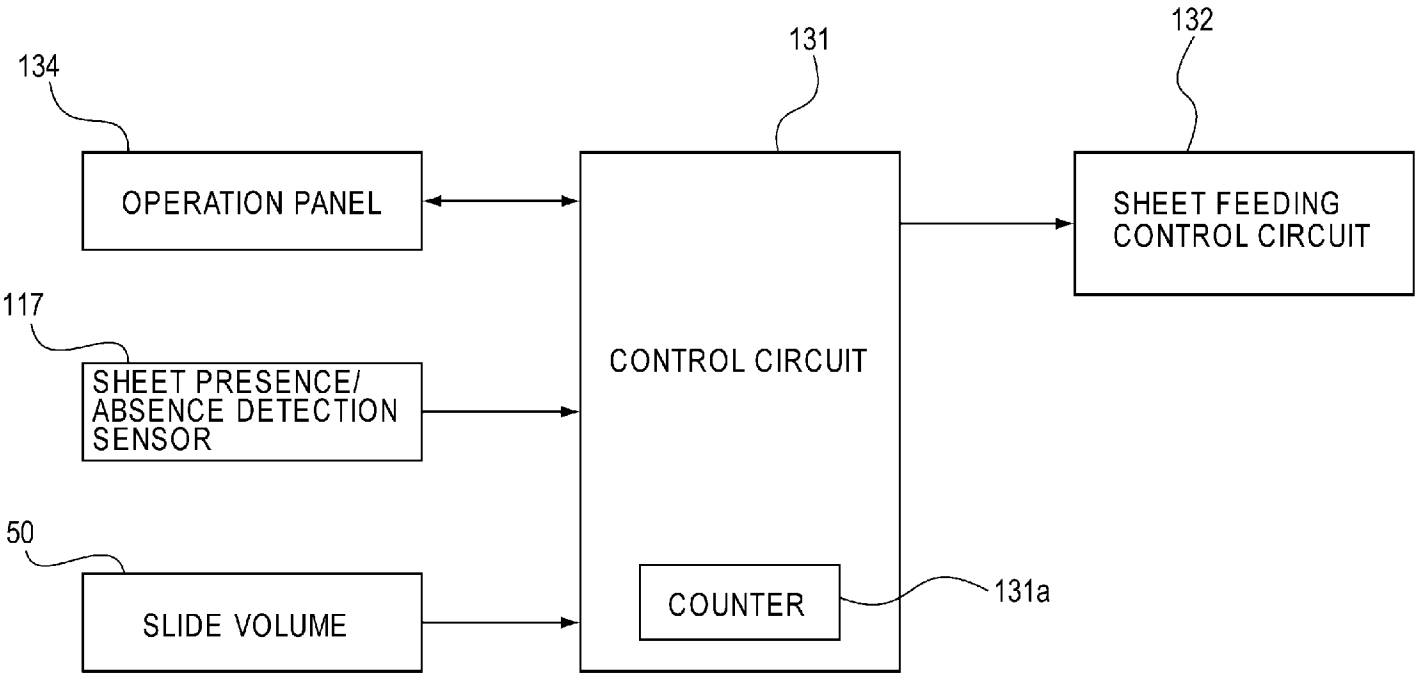
FIG. 5 is a control block diagram of the sheet feeding apparatus in FIG. 2.
Figure 6:
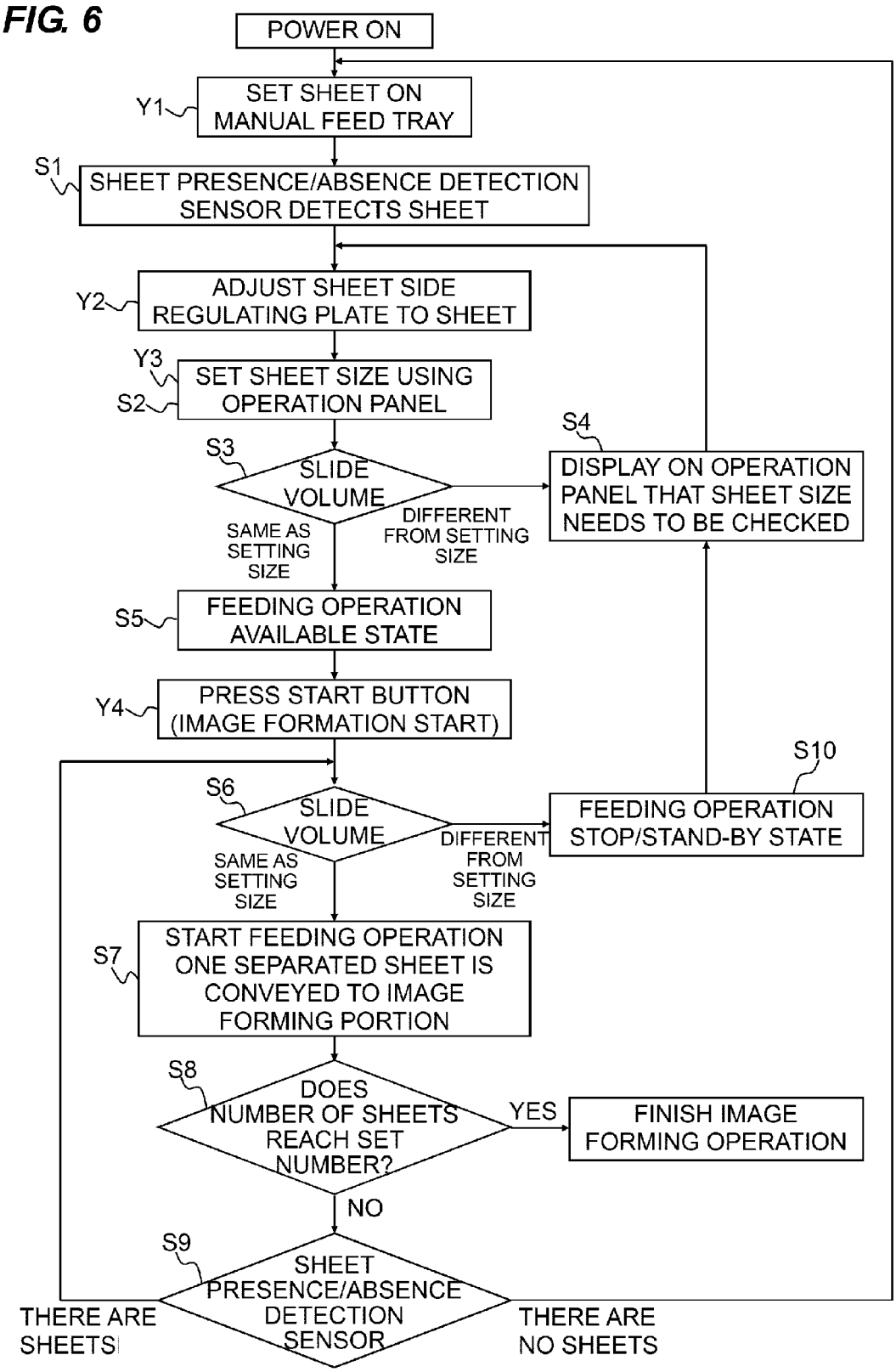
FIG. 6 is a flowchart for describing an operation of the sheet feeding apparatus illustrated in FIG. 2.

FIG. 2 is a schematic plan view of the sheet feeding apparatus according to an embodiment of the present invention. FIGS. 3A and 3B are front views for describing an operation of the sheet feeding apparatus in FIG. 2. FIG. 3A is a view of the sheet feeding apparatus on which the user places sheets. FIG. 3B is a view of the sheet feeding apparatus on which no sheet is placed. FIG. 4 is a plan view of a mechanism of detecting the positions of a pair of side regulating plates. FIG. 5 is a control block diagram of the sheet feeding apparatus in FIG. 2. FIG. 6 is a flowchart for describing an operation of the sheet feeding apparatus illustrated in FIG. 2.

The sheet feeding apparatus 100 is a so-called manual sheet feeding apparatus which feeds sheets placed on a manual feed tray 20 of the sheet tray by the user, to the interior of the apparatus body 201. The sheet feeding apparatus 100 mainly includes the manual feed tray 20, a sheet feeding roller 101, a separating roller 102, a pair of side regulating plates 21 and 22, a detecting portion 42, the operation panel 134 and a control circuit 131.

On the manual feed tray 20, the user stacks (places) sheets. The manual feed tray 20 includes a tray main body 20*c*, and a manual feed tray pressuring intermediate plate 20*a* (hereinafter "intermediate plate") provided to turn about a rotation center shaft 20*b* provided in the tray main body 20*c*. The downstream portion of the manual feed tray 20 in the sheet feeding direction is set lower than the upstream portion.

Sheets are placed on the intermediate plate 20*a* as illustrated in FIG. 3A at a standby position in FIG. 3B, and, when the sheets are fed, the intermediate plate 20*a* is pushed up in an arrow A direction by a push-up mechanism (not illustrated), rotates about the rotation center shaft 20*b* toward a sheet feeding position and makes the uppermost sheet P abut on the sheet feeding roller 101.

In the downstream of the manual feed tray 20 in the sheet feeding direction (arrow B direction), a sheet presence/absence detection flag 116 is provided which detects whether sheets are stacked on the manual feed tray 20. The sheet presence/absence detection flag 116 is provided to rotate about a rotation center shaft 116*a* provided to a fixing member. At a turning end in a lower part of the sheet presence/absence detection flag 116, a detection piece 116*b* is formed which is detected by a sheet presence/absence detection sensor 117. The sheet presence/absence detection sensor 117 is a general optical sensor.

As illustrated in FIG. 3B, when no sheets are stacked on the manual feed tray 20, the sheet presence/absence detection flag 116 becomes nearly upright because of the weight of the flag 116 and blocks detection light from the sheet presence/ absence detection sensor 117 by means of the detection piece 116*b*. By this means, the sheet presence/absence detection sensor 117 detects that no sheets are stacked on the manual feed tray 20.

As illustrated in FIG. 3A, when sheets are stacked on the intermediate plate 20*a*, the sheet presence/absence detection flag 116 is pushed by the sheets and rotates in an arrow C direction. Then, the detection piece 116*b* moves away from the sheet presence/absence detection sensor 117. By this means, blocking of detection light from the sheet presence/absence detection sensor 117 is stopped, and the sheet presence/absence detection sensor 117 detects that the sheets are stacked on the intermediate plate 20*a*.

In the downstream part of the manual feed tray 20 in the sheet feeding direction, the sheet feeding roller 101 which is a feeding member for feeding sheets stacked on the manual feed tray 20 and the separating roller 102 are arranged. The sheet feeding roller 101 and the separating roller 102 press each other. A predetermined separating torque coaxially works on the separating roller 102 from a torque limiter (not illustrated).

When the sheet presence/absence detection sensor 117 detects that the sheets are stacked on the manual feed tray 20, the sheet feeding roller 101 rotates in an arrow D direction to feed the sheets, and the separating roller 102 is rotated along with the sheet feeding roller 101 in an arrow E direction.

When the uppermost sheet abuts on the sheet feeding roller 101, the sheet feeding roller 101 and the separating roller 102 feed the uppermost sheet to the interior of the apparatus body 201. In this case, if, for example, the second and third sheets overlap the uppermost sheet, the separating roller 102 is rotated in a direction opposite to the arrow E direction by the separating torque, and separates the other sheets from the uppermost sheet and pushes the sheets back to the manual feed tray 20.

By this means, the sheet feeding apparatus 100 feeds the sheets stacked on the manual feed tray 20 by the user, to the apparatus body 201 one by one. When the stacked sheets on the intermediate plate 20*a* run out, the intermediate plate 20*a* returns to the standby position illustrated in FIG. 3B. Further, the sheet presence/absence detection flag 116 becomes upright because of the weight of the sheet presence/absence detection flag 116 and blocks light from the sheet presence/absence detection sensor 117. The sheet presence/absence detection sensor 117 detects that no sheets are stacked on the intermediate plate 20*a*, and stops rotation of the sheet feeding roller 101.

Although the sheet feeding apparatus 100 feeds sheets to the apparatus body 201 as described above, the sheet feeding apparatus 100 includes the side regulating plates 21 and 22 which are a pair of aligning members for aligning the widths of the sheets stacked on the manual feed tray 20 in the direction crossing the sheet feeding direction. Further, the sheet feeding apparatus 100 also includes the detecting portion 42 which is a size detecting portion for detecting the positions of a pair of side regulating plates 21 and 22 and detecting the width size of sheets. In addition, the sheet feeding direction is the arrow B direction (FIGS. 2 and 4), and the crossing direction (width direction) is an arrow F direction.

The pair of side regulating plates 21 and 22 makes racks 43 formed in the side regulating plates 21 and 22 enmesh with both sides of a pinion 44 and come close to and separate from each other to align side edges of sheets along the sheet feeding direction and align the widths of the sheets. Aligning portions 21*a* and 22*a* of the pair of side regulating plates 21 and 22 which abut slidably on the sheets are provided to slide on the intermediate plate 20*a* in the sheet width direction, and the racks 43 can move integrally with the aligning portions 21*a* and 22*a* on the lower surface of the intermediate plate 20*a*.

The detecting portion 42 is provided on the lower surface of the intermediate plate 20*a*. A belt 45 is laid over a rotary shaft 48 and a driven roller 49 of the pinion 44 provided on the lower surface of the intermediate plate 20*a*. The belt 45 is preferably made of rubber, or teeth are formed in the rotary shaft 48, driven roller 49 and belt 45 to prevent slippage against each other. The belt 45 is provided with a contactor 46 which slides on a resistor 47 fixed to the lower surface of the intermediate plate 20*a*. The resistor 47 and contactor 46 form a slide volume 50. FIGS. 3A and 3B do not illustrate, for example, the side regulating plates 21 and 22 and detecting portion 42.

When the user moves the pair of side regulating plates 21 and 22 closer to each other from the solid lines, the widths of the sheets P stacked on the manual feed tray 20 (FIG. 2) by the user are aligned and the sheets P are set at the normal position indicated by the broken lines. When the pair of side regulating plates 21 and 22 is moved closer to each other, the contactor 46 slides on the resistor 47. The detecting portion 42 detects the width size of the sheets according to a resistance value of the resistor 47 matching the position of the contactor 46 when the pair of side regulating plates 21 and 22 stops at normal positions.

The control relation of the sheet feeding apparatus 100 will be described with reference to FIG. 5.

A signal which is input to the operation panel 134 (FIG. 1) by the user and which is necessary to form an image is input to the control circuit 131. The control circuit 131 outputs a control signal to a sheet feeding control circuit 132 which controls rotation of the sheet feeding roller 101 and controls lifting and lowering of the intermediate plate 20*a* based on the input control signal required to form an image. This control signal is output based on the sheet presence/absence signal from the sheet presence/absence detection sensor 117. When the sheet presence/absence detection sensor 117 detects that "there are no sheets", the control circuit 131 does not transmit a control signal to the sheet feeding control circuit 132. When the sheet presence/absence detection sensor 117 detects that "there are sheets", the control circuit 131 transmits the control signal to the sheet feeding control circuit 132 to start feeding the sheets. When the sheet presence/absence detection sensor 117 detects that "there are no sheets" during the sheet feeding operation of the sheet feeding apparatus 100, the control circuit 131 stops the sheet feeding operation of the sheet feeding apparatus 100. At the same time, the control circuit 131 displays on the operation panel 134 that sheets need to be set.

According to these operations, the sheet width size information from the detecting portion 42 is input to the control circuit 131 immediately before the sheet feeding operation of the sheet feeding apparatus 100 is started. Further, sheet width size information from the operation panel 134 which is an information inputting portion which receives an input of sheet width size information from the user is also input to the control circuit 131.

The control circuit 131 which is the controlling portion compares width size information detected by the detecting portion 42 and width size information input in the operation panel 134. When the two pieces of width size information match, a sheet feeding start signal is output to the sheet feeding control circuit 132 based on determination that sheets can be fed. When the two pieces of width size information are different, the control circuit 131 stops the sheet feeding operation of the sheet feeding roller 101 and the separating roller 102, and displays on the operation panel 134 of the display portion that the sheet widths need to be aligned by the pair of side regulating plates 21 and 22. Subsequently, when the user moves the side regulating plates 21 and 22 to the positions for aligning the sheets, sheet width size information detected by the detecting portion 42 matches with sheet width size information input to the operation panel 134. The control circuit 131 outputs to the sheet feeding control circuit 132 a signal for starting feeding the sheets, and makes the sheet feeding roller 101 and the separating roller 102 start the sheet feeding operation.

Incidentally, when the two pieces of width size information match and the side regulating plates 21 and 22 are guiding feeding of the sheets at the positions indicated by the broken lines illustrated in FIG. 2, if the sheets are jammed in the apparatus body 201, the user stops feeding the sheets and removes the jammed sheets. In this case, there are cases where the user contacts the pair of side regulating plates 21 and 22 and displaces the positions of the side regulating plates 21 and 22 from the positions indicated by the broken lines to the positions indicated by the solid lines. If this displacement occurs, when the sheets are fed thereafter, the sheets are fed in an oblique state and are jammed in the sheet feeding apparatus 100 or in the apparatus body 201.

Consequently, when no sheet is temporarily fed and the user displaces the positions of the side regulating plates, the sheet feeding apparatus 100 according to the present invention can detect the displacement of the positions of the side regulating plates and stop feeding sheets.

Hereinafter, an operation of stopping feeding sheets when no sheet is temporarily fed and the user displaces the positions of the side regulating plates will be described with reference to the flowchart illustrated in FIG. 6. In addition, the symbol "Y" in the flowchart refers to a user's operation, and the symbol "S" refers to an operation of the sheet feeding apparatus.

The user places sheets on the manual feed tray 20 of the sheet feeding apparatus 100 in the standby state (Y1). The sheet presence/absence detection sensor 117 detects that the sheets are placed on the manual feed tray 20 (S1). The user aligns the widths of the sheets by means of the side regulating plates 21 and 22 (Y2). Sheet information about a sheet width size, and thick paper, recycled paper or OHP is input to the operation panel 134 (Y3 and S2). In addition, width size information about irregular sheets can also be input to the operation panel 134 in addition to width size information of regular sheets. The slide volume 50 of the detecting portion 42 detects the positions of the side regulating plates 21 and 22, and detects the sheet width size.

The control circuit 131 determines whether sheet width size information input to the operation panel 134 and sheet width size information detected by the slide volume 50 match (S3). When the two pieces of sheet width size information do not match (different from the setting size in S3), the control circuit 131 displays on the operation panel 134 that the two pieces of sheet width size information do not match and displays that the positions of the side regulating plates 21 and 22 need to be checked (S4).

The cases where the two pieces of sheet width size information do not match include at least one of a case where the positions of the side regulating plates 21 and 22 are displaced from the positions for aligning sheet widths and a case where sheet width size information input to the operation panel 134 is wrong.

When the user checks the positions of the side regulating plates 21 and 22, if the positions are displaced, the user aligns the side regulating plates to the sheets again (back to Y2). Further, if sheet width size information input to the operation panel 134 is wrong, sheet width size information is input again in the operation panel 134 (Y3 and S2).

When the two pieces of sheet width size information match (same as the setting size in S3), the sheet feeding apparatus 100 can start feeding the sheets (S5). The user inputs setting information (the number of set sheets and a mode (duplex or single-sided printing)) about image formation in the operation panel 134, and presses a start button (not illustrated) (Y4). In addition, setting information about image formation may be input in processing Y3.

Features of the present invention include that the control circuit 131 compares sheet width size information of the detecting portion 42 and sheet width size information input to the operation panel 134 per sheet before the sheet feeding roller 101 and the separating roller 102 start feeding sheets.

Hence, immediately before the sheet feeding operation is started, the control circuit 131 compares sheet width size information of the detecting portion 42 and sheet width size information input to the operation panel 134. After the start button is pressed (Y4), whether the first sheet matches with sheet width size information is detected in processing S6. When the setting size is determined to be the same in S6, the sheet feeding apparatus feeds the first sheet to the interior of the apparatus body (S7). The sheets fed to the interior of the apparatus body 201 are discharged to the tray 218 (FIG. 1) after images are formed thereon. Even when a plurality of sheets is set, the setting size of the sheets in the operation panel and the size detected by the side regulating plates are checked one by one before the sheet feeding operation if these are the same size.

The control circuit 131 determines whether the number of sheets on which images are formed reaches the set number of sheets (S8). The number of the sheets is detected when a sensor provided in the sheet feeding apparatus 100 or the apparatus body 201 detects that the sheets pass and a counter 131*a* in the control circuit 131 counts the number of the sheets. When the number of the sheets reaches the set number of sheets (YES in S8), the control circuit 131 stops the sheet feeding operation of the sheet feeding apparatus 100. When the number of the sheets does not reach the set number of sheets (NO in S8), the control circuit 131 determines whether subsequent sheets are stacked on the manual feed tray 20, based on the operation of the sheet presence/absence detection sensor 117 (FIGS. 3A and 3B) (S9). When the subsequent sheets are not stacked, the control circuit 131 returns to processing Y1. When the subsequent sheets are stacked, the control circuit 131 returns to processing S6. In both cases, the control circuit 131 compares sheet width size information of the detecting portion 42 and sheet width size information input to the operation panel 134 again (S3 and S6).

While the control circuit 131 returns from processing S9 to processing S6, jamming of the sheets occurs in the sheet feeding apparatus 100 or apparatus main body 201 and the jammed sheets are removed, and therefore there are cases where no sheet is temporarily fed and the user displaces the positions of the side regulating plates. Further, it is assumed that, after the size is set in the operation panel, the side regulating plates are moved by a user's unintentional error operation. In this case, when the control circuit 131 returns from processing S9 to processing S6, sheet width size information of the detecting portion 42 and sheet width size information input to the operation panel 134 are different in processing S6 (different from the setting size in S6). Hence, the control circuit 131 stops rotation of the sheet feeding roller 101 and the separating roller 102 to stop the sheet feeding operation of the sheet feeding apparatus 100 (S10). Further, the control circuit 131 displays on the operation panel 134 that the two pieces of sheet width size information do not match and displays that the positions of the side regulating plates 21 and 22 need to be checked (S4). The user executes processing Y2.

While the control circuit 131 returns from processing S9 to processing S6, if the user does not displace the positions of the side regulating plates 21 and 22 (same as the setting size in S6), the control circuit 131 transitions to processing S7.

Further, when images are formed on a predetermined number of the sheets (YES in S8), the control circuit 131 stops the sheet feeding operation of the sheet feeding apparatus 100.

Thus, the sheet feeding apparatus 100 according to the present invention checks whether sheet width size information input to the operation panel 134 and sheet width size information detected by the detecting portion 42 match, one by one before feeding of the sheets is started. Further, the sheet feeding apparatus 100 feeds the sheets by means of the sheet feeding roller 101 and the separating roller 102 when the two pieces of sheet width size information match and stops feeding the sheets by means of the sheet feeding roller 101 and the separating roller 102 when the two pieces of sheet width size information do not match. Further, when the two pieces of sheet width size information do not match, the sheet feeding apparatus displays on the operation panel 134 for the user to check that the side regulating plates 21 and 22 are set at the positions for a desired width size of the sheets to be fed. When the user adequately sets the side regulating plate 22 at the predetermined position and the two pieces of sheet width size information match, the sheet feeding apparatus starts feeding the sheets by means of the sheet feeding roller 101 and the separating roller 102. The sheets fed by the sheet feeding roller 101 and the separating roller 102 are discharged to the tray 218 after toner images are formed thereon in the apparatus body.

Consequently, when no sheet is temporarily fed and the user displaces the positions of the side regulating plates, the sheet feeding apparatus can detect that the positions of the side regulating plates are displaced and stop feeding the sheets, so that it is possible to prevent skew feeding of the sheets. Consequently, the sheet feeding apparatus can feed the sheets without causing jamming of the sheets. Further, the image forming apparatus having this sheet feeding apparatus forms images on sheets which are skew fed little, and, consequently, can increase quality of image formation and reduce jamming of the sheets while the sheets are conveyed and reduces the rate that images are formed again.

In addition, there are cases where the sheet feeding apparatus is commonly used in an image forming apparatus of a different specification.

For example, the width size of sheets which can be stacked on the manual feed tray 20 of the sheet feeding apparatus is 320 mm. The image forming apparatus in which this sheet feeding apparatus is commonly used includes the following three types.

Image forming apparatus A: the maximum width size of sheets on which images can be formed is an A3 size (297 mm wide).

Image forming apparatus B: the maximum width size of sheets on which images can be formed is an SR-A3 size (320 mm wide).

Image forming apparatus C: the maximum width size of sheets on which images can be formed is an A4-R size (210 mm wide).

Even when the sheet feeding apparatus is equipped in any of three types of the image forming apparatuses, the sheet feeding apparatus can determine whether sheet width size information detected by the detecting portion and sheet width size information input to the operation panel match, and determine whether to feed sheets.

For example, with the image forming apparatus C, an image up to 210 mm (A4-R feed) can only be formed, and therefore the A4 width (297 mm) of the sheet width size cannot be set in the operation panel. Incidentally, in the past, after the width size is set to 210 mm (A4-R feed) in the operation panel, the user erroneously places sheets of the A4 width (297 mm) on a manual feed tray on rare occasions in a state where the sheet presence/absence detection sensor does not detect that there are no sheets. In this case, a conventional sheet feeding apparatus feeds the sheets of the A4 width (297 mm), and therefore jamming of the sheets occurs in the apparatus body 201 of the image forming apparatus.

However, even if the sheets of the A4 width (297 mm) are placed on the manual feed tray erroneously after 210 mm is set in the operation panel, the sheet feeding apparatus according to the present invention checks whether the two pieces of width size information match every time before the sheets are fed one by one, and, consequently, does not feed the sheets which are set erroneously.

Consequently, even when the sheet feeding apparatus is commonly used in the image forming apparatus of a different specification, the sheet feeding apparatus can prevent in advance jamming of sheets which are out of the range of the width size which allows the image forming apparatus to form images.

In addition, although the above sheet feeding apparatus aligns the sheet widths by sandwiching sheets from both sides by means of a pair of side regulating plates, the sheet feeding apparatus may align sheet widths by pushing one side edge of the sheets along the sheet feeding direction by means of the side regulating plates and pushing the other side edge against a fixed aligning wall. In this case, there is one moving side regulating plate, and the sheet width size is detected according to the position of this one moving side regulating plate.

Further, the above sheet feeding apparatus may feed document by providing the sheet feeding apparatus not only in the image forming apparatus, but also in an inlet which feeds document in a document conveying apparatus which feeds document.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-188238, filed Aug. 25, 2010, which is hereby incorporated by reference herein in its entirety.

What is claimed is:

1. An image forming apparatus which includes a sheet feeding apparatus and an image forming portion which forms an image on a sheet fed from the sheet feeding apparatus, the image forming apparatus comprising:

a sheet tray on which the sheet is stacked;

a feeding member which feeds the sheet stacked on the sheet tray;

an aligning member which aligns a width of the sheet stacked on the sheet tray, in a direction crossing a sheet feeding direction;

a size detecting portion which detects the width of the sheet stacked on the sheet tray based on a detection of a position of the aligning member;

an information inputting portion which receives an input of width size information of the sheet;

a start button which indicates a start of a sheet feeding operation to feed the sheet stacked on the sheet tray by the feeding member; and a controlling portion which compares the width size information based on a detection of the size detecting portion and the width size information of the information inputting portion after the start button is pressed to indicate the start of the sheet feeding operation by the feeding member and before the feeding member starts feeding the sheet stacked on the tray, and the controlling portion does not start a sheet feeding operation of the feeding member when the pieces of width size information are different.

2. The image forming apparatus according to claim 1, further comprising a display portion which displays that the position of the aligning member needs to be adjusted when the controlling portion stops the sheet feeding operation of the feeding member.

3. The image forming apparatus according to claim 1, wherein the sheet tray is a manual feed tray.

4. The image forming apparatus according to claim 1, wherein in a case where the controlling portion has started the sheet feeding operation, the controlling portion stops the sheet feeding operation of the feeding member when the width size information of the size detecting portion is out of a range of a width size which allows the image forming portion to form an image on a sheet.

5. The image forming apparatus according to claim 1, wherein in a case where the controlling portion does not start a sheet feeding operation of the feeding member when the pieces of width size information are different, the feeding member starts to feed the sheets after the two pieces of sheet width size information become matched.

6. The image forming apparatus according to claim 1, wherein a controlling portion compares the width size information based on a detection of the size detecting portion and the width size information of the information inputting portion when the width size information is input the controlling portion after the sheet is aligned by the aligning member, and the controlling portion does not start a sheet feeding operation of the feeding member when the pieces of width size information are different.

7. The image forming apparatus according to claim 1, wherein the width size information of the sheet is input by an operation panel and the start of an image forming is indicated by a start button.

* * * * *